United States Patent [19]

Bevacqua

[11] Patent Number: 4,930,270

[45] Date of Patent: Jun. 5, 1990

[54] BUILDING SYSTEMS

[76] Inventor: Aldo Bevacqua, Cnr. Minchinton Street and The Esplanade, Bulcock Beach, Caloundra. Qld. 4551, Australia

[21] Appl. No.: 428,465

[22] Filed: Oct. 27, 1989

Related U.S. Application Data

[63] Continuation of Ser. No. 91,787, Sep. 1, 1987, abandoned.

[51] Int. Cl.[5] ..... E04F 15/024; E04G 1/00

[52] U.S. Cl. ..... 52/126.1; 52/126.7; 52/263; 52/297; 248/188.4; 248/354.5; 248/357; 248/650

[58] Field of Search ..... 52/90, 126.6, 262, 263, 52/264, 126.7, 297, 298, 299, 126.1, 126.3, 126.4, 296; 182/178; 248/188.4, 354.5, 357, 650

[56] References Cited

U.S. PATENT DOCUMENTS

| | | | |
|---|---|---|---|
| 1,996,358 | 5/1935 | Werner | 52/126.7 |
| 3,130,470 | 4/1964 | Bowden et al. | 52/263 X |
| 3,292,314 | 12/1966 | Heize | 52/126.7 X |
| 3,527,436 | 9/1970 | Stone | 248/188.4 |
| 3,802,139 | 4/1974 | Eischen et al. | 52/263 X |
| 3,875,712 | 4/1975 | Thompson | 52/263 |
| 3,924,370 | 12/1975 | Cauceglia et al. | 52/263 |
| 3,927,498 | 12/1975 | Benedetti | 52/264 |
| 4,302,962 | 12/1981 | Williams | 248/188.4 X |
| 4,348,843 | 9/1982 | Cairns | 52/299 X |
| 4,479,342 | 10/1984 | Eberle | 52/90 X |
| 4,633,626 | 1/1987 | Freeman et al. | 52/90 X |
| 4,635,413 | 1/1987 | Hansen et al. | 52/262 X |
| 4,653,239 | 3/1987 | Randa | 52/90 |

FOREIGN PATENT DOCUMENTS

| | | | |
|---|---|---|---|
| 985471 | 3/1976 | Canada | 52/126.1 |
| 2125372 | 1/1979 | Fed. Rep. of Germany | 182/179 |
| 2418319 | 10/1979 | France | 52/126.6 |
| 571604 | 8/1945 | United Kingdom | 52/298 |
| 2192213 | 1/1988 | United Kingdom | 52/126.1 |

*Primary Examiner*—Carl D. Friedman
*Assistant Examiner*—Jerrold D. Johnson
*Attorney, Agent, or Firm*—Poms, Smith, Lande & Rose

[57] ABSTRACT

A building system which utilizes flooring supported by adjustable posts and individual beams extending between the posts which may be temporarily supported in excavations to enable the floor to be erected, and then adjusted for level. The excavations are subsequently filled with concrete to form footings. The posts may extend upwardly beyond the floor beams to form wall supports.

7 Claims, 6 Drawing Sheets

BUILDING SYSTEMS

This is a continuation of copending application Ser. No. 091,787 filed on Sept. 1, 1987, now abandoned.

This invention relates to improved building systems.

In particular this invention relates to building systems which will facilitate erection of floors and prefabricated buildings such a kit homes and the like. However it is to be understood that aspects of this invention can also be used for conventional one-off building construction.

Many kit homes are build on a concrete floor slab using prefabricated wall and roofing components. Many such kit homes are promoted as being able to be assembled without individual fitting of components. While it may be possible to achieve such an assembly, to do so requires the floor slab upon which the building is erected to be prefectly flat with the wall connections thereto accurately placed. Of course any inaccuracy in the foundations or connections thereto will reflect throughout the building. Thus in many kit homes it is frequently necessary to individually shape and fit components.

Another disadvantage associated with many kit homes is that internal structural walls are required to brace the structure in order to comply with code loadings, particularly if the building is to be erected in a cyclone prone area. Thus in such buildings the layout is inflexible and the owners cannot substantially modify the layout to suit their own requirements. Kit homes are relatively small and are built for reasons of economy. However as they are generally built on a concrete slab, additions thereto require one-off construction techniques.

The present invention aims to alleviate the above-mentioned disadvantages and to provide a floor system and building systems and components therefore which will be reliable and efficient in use. Other objects and advantages of this invention will hereinafter become apparent.

With the foregoing and other objects in view, this invention in one aspect resides broadly in a method of erecting an elevated floor, the method including providing a plurality of adjustable post assembles having floor brackets for supporting elevated floor beams; arranging the supporting posts in a selected grid; interconnecting said floor brackets by floor beams and adjusting the height of said supporting post assemblies to arrange corresponding faces of said floor beams in a selected horizontal plane.

Preferably, the lower end of each supporting post assembly is provided with an adjustable supporting foot whereby the inclination and/or the vertical position of its associated supporting post may be adjusted. It is also preferred that the supporting posts be arranged in in-ground holes provided with a pad at their base for said supporting feet. The supporting feet may include a plate on the bottom end of the supporting post provided with spaced adjusting screws offset from the post axis whereby the screws may be vertically adjusted for height adjustment of the post and for supporting the post in a vertical attitude.

The method of erection preferably begins by arranging the supporting posts in respective one of a plurality of holes; interconnecting a selected one set of four posts arranged in a rectangular grid with fixed length floor beams and subsequently interconnecting all supporting posts with floor beams extending between adjacent posts. All supporting posts may then be adjusted for plumbness and height by adjusting their supporting feet.

According to the present method, erection continues by placing floor joists, flooring prior to concreting the supporting posts in said holes so that final adjustment of the posts may be made to ensure that the floor is level. Placement of concrete in the post holes may be carried out after wall and roof frames have been erected if desired. This enables the frames to be plumbed and levelled prior to the supporting posts being finally set into place.

In another aspect, this invention resides in a post assembly for supporting an elevated floor and including a lower post portion provided with a foot whereby the height and inclination of the lower portion may be adjusted; an upper post portion adjusted engageable with the lower post portion and adapted to be supported thereby in selected vertically adjustable relationship and said upper post portion being provided with floor brackets for supporting floor bearers or the like. The floor brackets may include a horizontal plate upon which the bearer may rest and an associated vertically extending holding plate adapted to be through bolted to the bearer. The holding plate may be constituted by one side wall if a socket in which the end of a bearer may be located or the holding plate may locate within a slot in the end of a bearer.

Each foot at the lower end of said supporting posts may be in the form of a plate adapted for support on granular material such as sand which may be used to adjustably support the pad. The upper post portions may terminate level with the supporting surface of the bearer and may provide a socket for a suitable wall post.

Preferably the upper post portions extend upwardly beyond said floor brackets for supporting the lower ends of a wall column or stud or the like, which may be integral with the upper post portions or connected thereto. In the preferred form the upper and lower portions of the supporting posts are formed of tubular steel suitably of round or square configuration and are telescopically engageable for vertical adjustment and the foot of the lower portion is provided with a mounting plate through which a plurality of adjusting bolts are threadedly engaged for vertical adjustment. The supporting posts may extend upwardly beyond the elevated floor brackets to support roof brackets or roof supporting posts or the like.

Each supporting post may include a lower portion provided with the adjustable bolts and an upper portion telescopically engageable thereabout and there being provided a plurality of registrable holes in the upper and lower post portions to enable coarse height adjustment to be achieved. Preferably the supporting posts are formed from steel and the connector means for supporting the bearers comprise connector flanges welded to the upper portion of the post and adapted to be bolted to the bearers.

In a further aspect this invention resides broadly in a building construction including a rectangular perimeter wall frame having in each wall a bracing panel extending between the floor and the head of the respective perimeter wall frame and each bracing panel being so made and arranged that it is capable of transferring wind loadings applied thereto through the adjacent wall or walls to the floor structure of the building. Each bracing panel may include a rectangular perimeter frame formed of timber and a pair of metal straps extending diagonally between the top and bottom rails of the perimeter frame, the latter being covered by cladding sheets adhered to opposite sides thereof. Preferably, in a rectangular building construction a bracing panel of the type described above is arranged at the opposite ends of each wall adjacent a corner post. The building includes an array of central columns supporting hip rafters at positions intermediate the external walls and the apex of the roof. The column mounting for each hip rafter may be saddle like and there may be provided further mountings for connecting the intermediate or horizontal rafters thereto.

In order that this invention may be more readily understood and put into practical effect, reference will now be made to the accompanying drawings which illustrate a typical embodiment of this invention and wherein.

Figure 1:
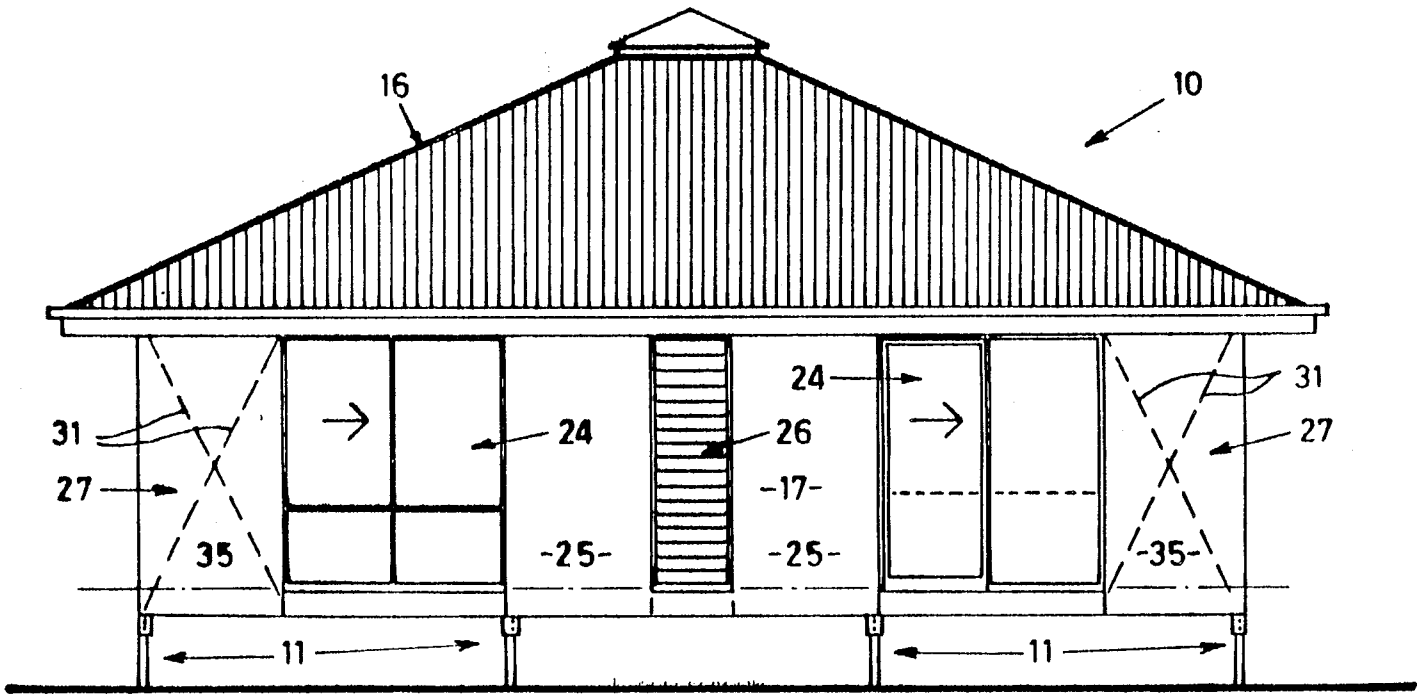
FIG. 1 is a front elevation of a typical dwelling made in accordance with this invention.
Figure 2:
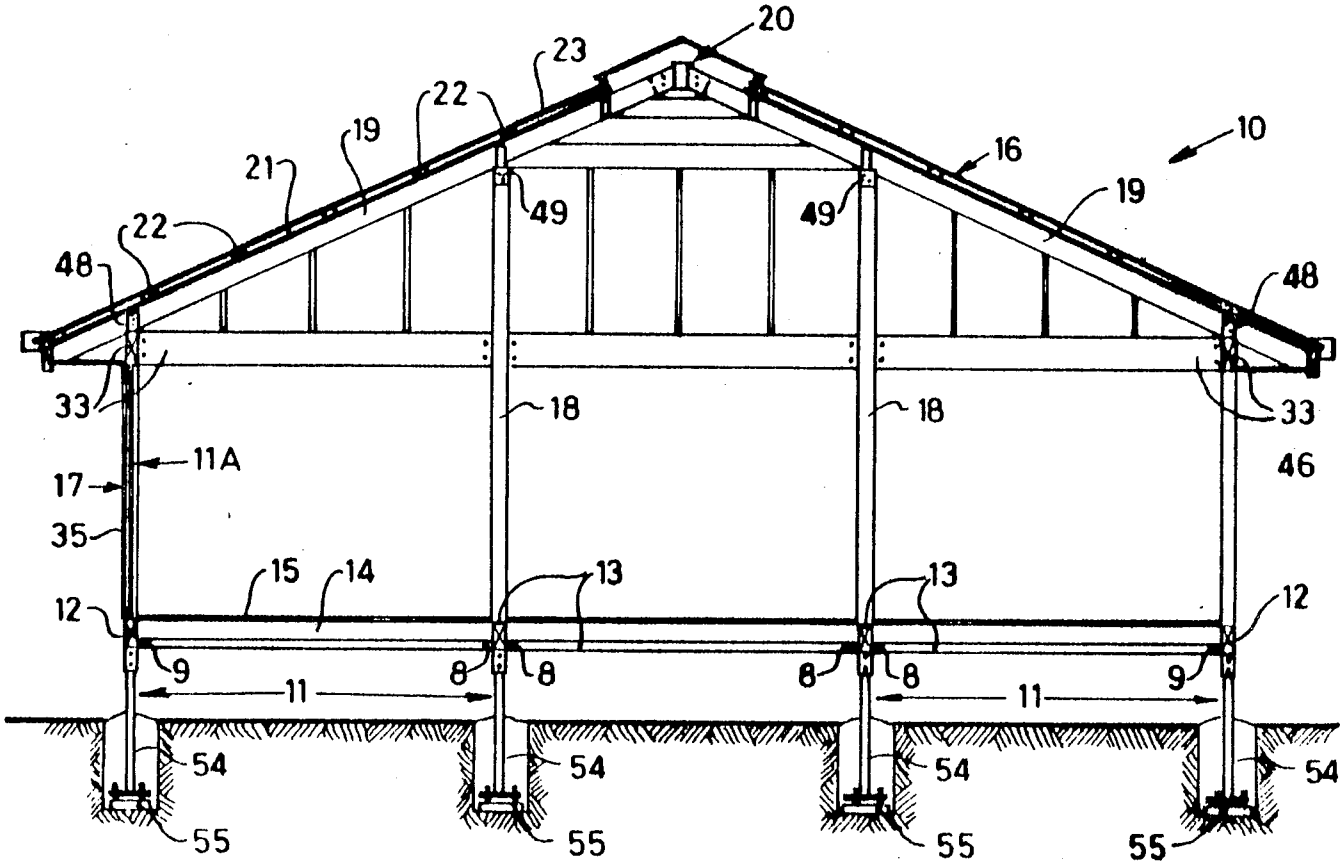
FIG. 2 is a section illustrating the construction details of the dwelling.

Referring to the drawings it will be seen that dwelling 10 is supported by post assemblies 11 arranged in a square grid pattern. The post assemblies 11A around the perimeter of the building continues upwardly to form side wall posts, while the central post assemblies 11B terminate above the floor bearers 12. Pre-cut fixed length bearers 12 and 13 extend between respective pairs of adjacent posts 11. The outer bearers 12 are provided with a joist supporting plate 9 along their inner lower side faces, while the intermediate bearers 13 are provided with joist supporting plates 8 along each lower side face. Floor joists 14 extend between the bearers at regularly spaced intervals. The joists are factory formed to identical depths so that when supported on the plates 8 and 9 they terminate flush with the upper surface of the bearers 12 and 13. Suitable flooring 15 is supported on and secured to the joists 14 and bearers 12 and 13. A hip roof 16 is supported by the exterior walls 17 and four central columns 18 which extend upwardly from the central post assemblies 11. The columns 18 each extend upwardly to support an intermediate portion of a respective hip rafter 19. The rafters 19 extend inwardly beyond the respective columns 18 and interconnect at 20 centrally above the floor 15. In this embodiment the ceiling 21 is supported above the hip rafters 19 by battens 22 upon which the roof sheeting 23 is mounted.

As illustrated in FIG. 1 each side wall 17 is constituted by a series of panels which extend between the post assemblies 11A. In this embodiment the panels comprise a pair of window panels 24, door panels 25, a central louvre panel 26 and a pair of bracing panels 27 which extend inwardly from the corner post assemblies 11A. A pair of bracing panels 27 are incorporated in each of the four side walls 17 and are arranged to provide all the bracing required to enable the dwelling 10 to meet code requirements for wind loads whereby structural interior bracing walls are not required. Thus the interior of the building may be left in open plan or divided up with non-load bearing walls as desired.

Each bracing panel 27 is provided with a pair of flat steel bracing straps (shown dotted at 31) extending diagonally between the opposite corners of the panel and internally of the external cladding. The bracing straps 31 are through bolted by coach bolts to the head frame 33 and the bearers 12. The bracing panels 27 may be prefabricated or alternatively the bracing strap 31 may be installed insitu between the respective head plates 33 and floor bearers 12 whereupon the cladding sheet 35 may be secured to the head and bearer.

Figure 3:
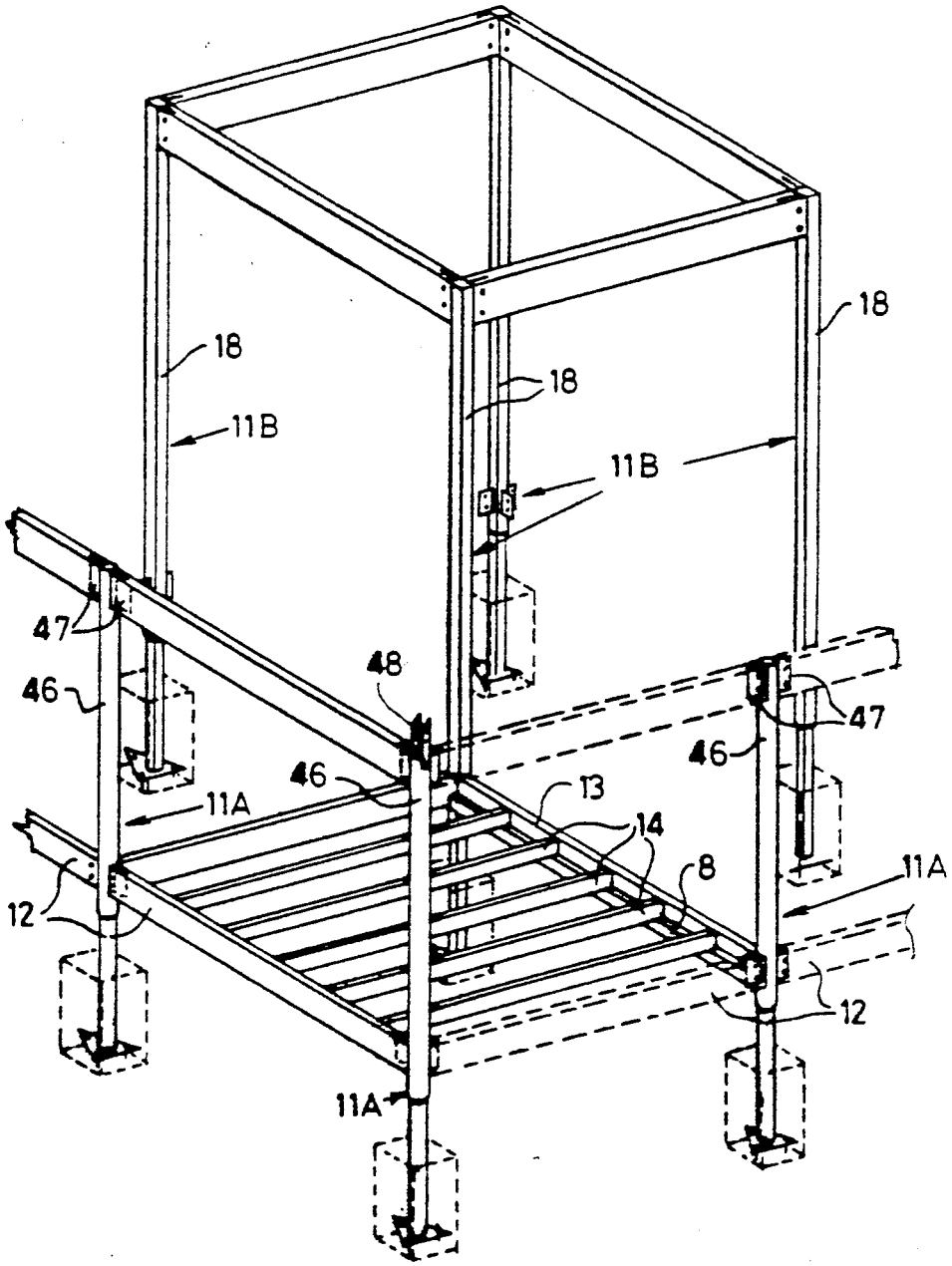
FIG. 3 is a perspective view which illustrates the arrangement of the adjustable post assemblies and the floor and the wall frames.
Figure 4:
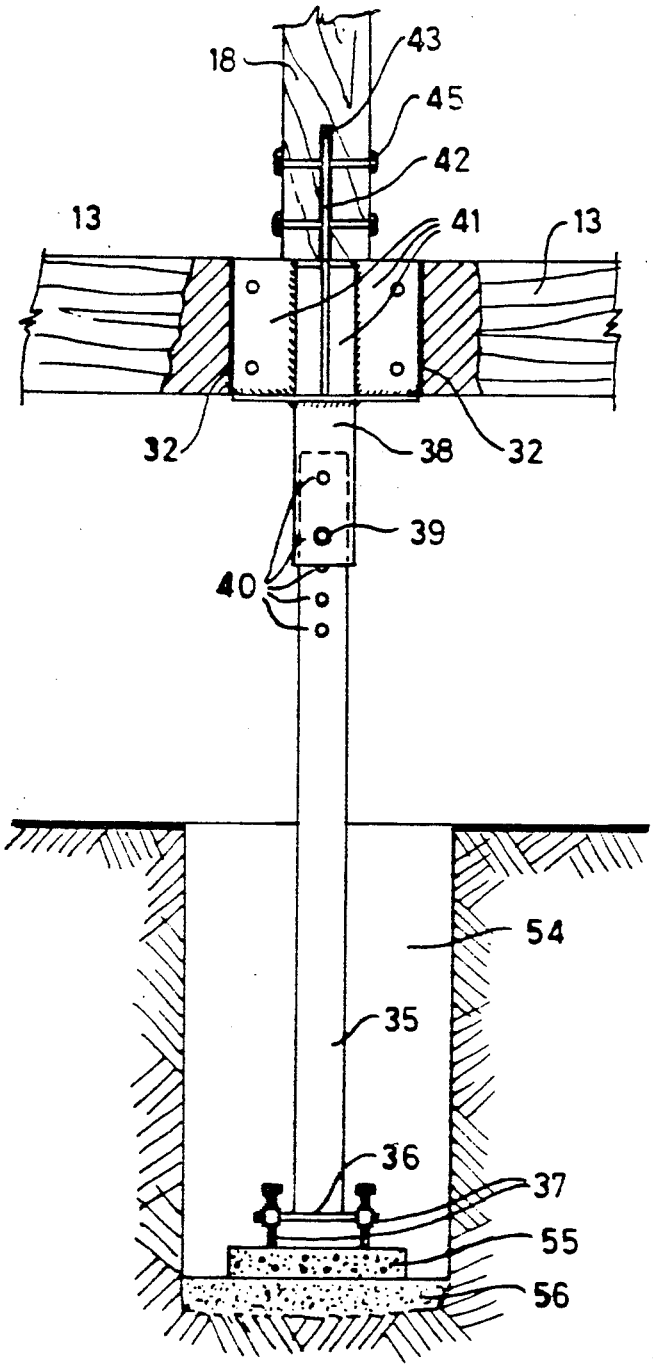
FIG. 4 is an enlarged side view of a typical adjustable post.
Figure 5:
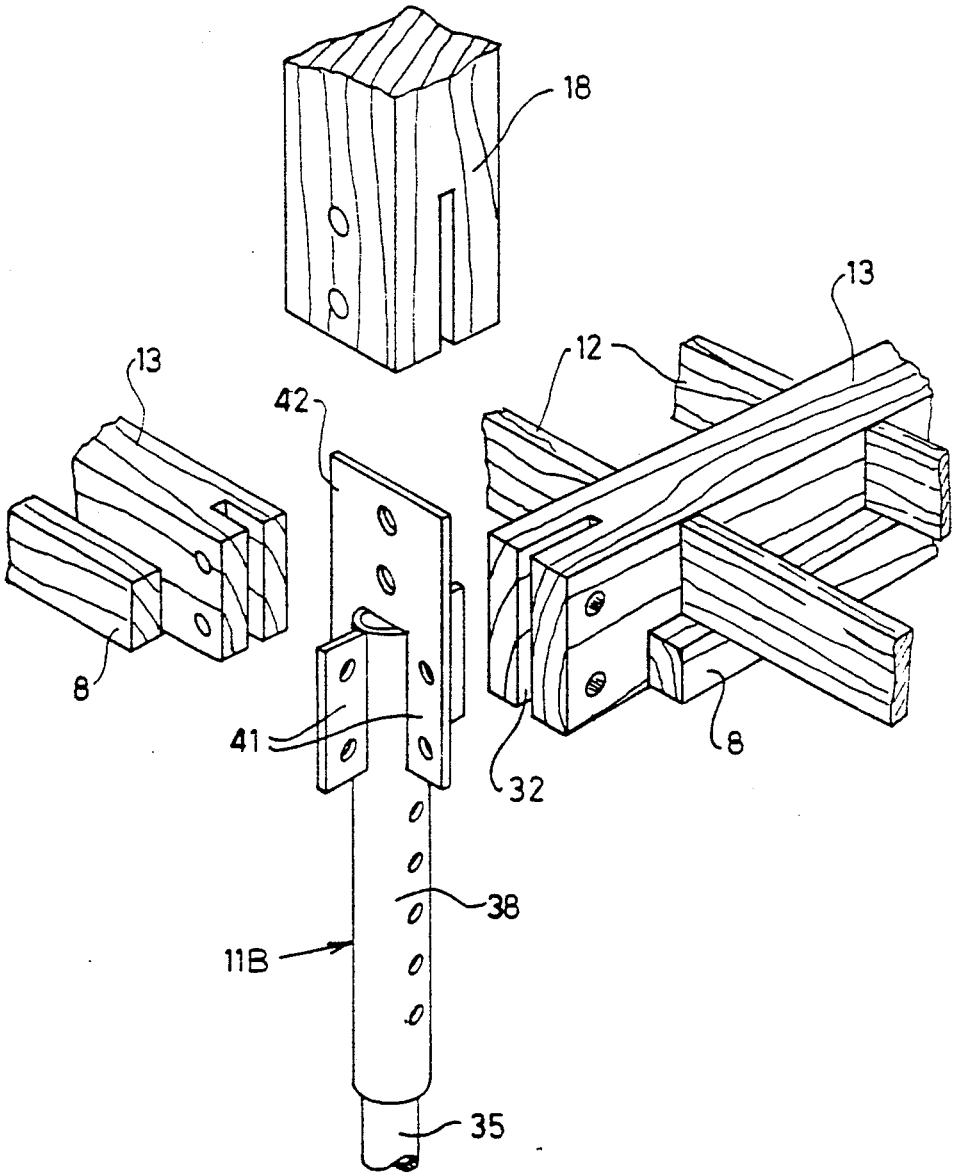
FIG. 5 is a perspective view illustrating a typical connection between joists, bearers and posts.

As shown in FIGS. 3 and 4, each post assembly 11 includes a lower tubular steel part 35 provided with a triangular shaped foot plate 36 at its lower end and through which respective adjusting bolts 37 are threadedly engaged for vertical adjustment. The three adjusting bolts 37 enable the height and the inclination of the post assembly 11 to be selectively adjusted.

The upper end of the lower part 35 is received telescopically within the tubular upper part 38 which may be adjustably connected thereto by inserting a pin 39 through selected mating apertures 40 in the upper post 38 and the lower part 35. The upper end of the upper post 38 is provided with floor brackets in the form of radially extending flanges 41 to which the bearers 12 and 13 may be bolted. The ends of the bearers 12 and 13 which are shown cutaway in FIG. 4 are slotted at 32 to receive the flanges 41. The bearers 12 and 13 are predrilled for bolting to the flange 41.

An upwardly extending tongue 42 is fixed to the floor brackets 41. This tongue 42 is adapted to be received in a slot 43 machined in the lower end of the column 18 and through bolted thereto by through bolts 45 as illustrated. The tubular upper part 38 of each post assembly 11A continues upwardly beyond the floor bracket 41 to form tubular steel posts 46 which support the side walls 17. These posts 46 are provided with roof bracket 47 at their upper ends. The roof brackets 47 are similar to the floor brackets 41. A pair of spaced cleats 48 extend upwardly above the roof bracket 47 on the corner ports 46. These cleats support the outer ends of the hip rafters 19.

Figure 6:
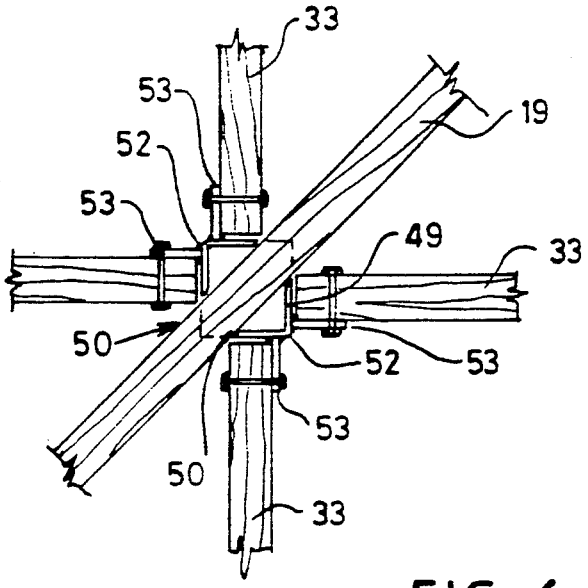
FIGS. 6 and 7 illustrates typical roof frame details.
Figure 7:
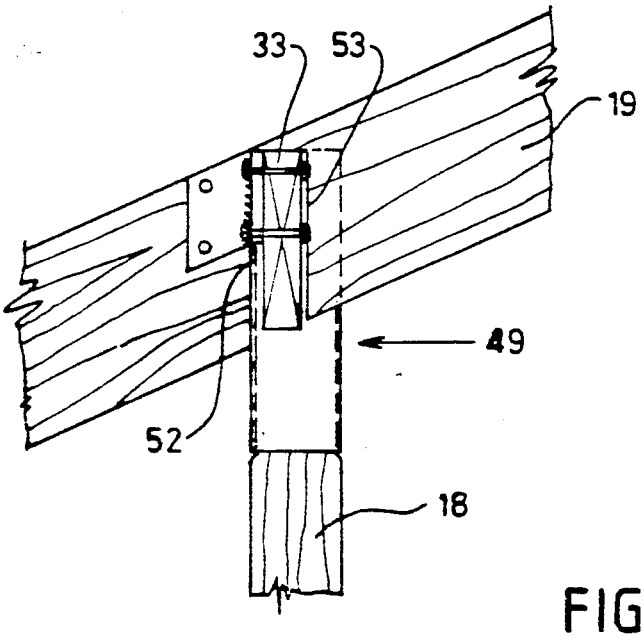

As the columns 18 may be exposed within the dwelling 10 they are suitably formed of timber and their upper end is adapted to engage within and be bolted to a square steel socket mounting 49 as shown in FIGS. 6 and 7. The upper end of the socket mounting 49 is slotted at 50 to enable the hip rafters 19 to engage between the opposed remaining angle portions 52. Further cleats 53 are welded to the opposite faces of these angle portions 52 to provide a bolted connection for the respective head plates 33.

In order to erect the prefabricated building illustrated, the footings 54 are excavated and the supporting post assemblies 11 are supported on respective concrete pads 55 which are preferably bedded in sand 56. The coarse adjustment between the upper and lower parts of each post is performed by pinning through the appropriate mating apertures 40 so that the floor is supported substantially at the required level. The floor bearers 12 and 13 are then placed in position and interconnected to their respective post assemblies 11 and initially to the four posts 11 at one corner of the grid so as to form a relatively rigid corner structure from which the remaining posts can be supported during erection. Nailing brackets 60 may be used to secure the joists 14 to the bearers 12 and 13 and plates 8 and 9.

The roof brackets 47 on the posts are then connected together by pre-cut head plates 33. The joists 14 and flooring 15 may then be secured. The walls may then be formed with the required panels and the hip rafters and the roof installed to provide a lockable building able to withstand the normal applied loads. The interior of the building can then be divided up as required by non-structurable walls or the like. Final adjustment of the adjusting bolts 37 may be performed at this stage to level the floor bearers and to plumb the supporting posts. When this has been achieved the footings are filled with mass concrete. Of course this step can be carried out earlier if desired.

It will be seen from the above that the building may be erected quickly with final adjustment performed after all major pre-fabricated components have been bolted together to ensure that the final structure is level and plumb. Furthermore as the building is connected to the upright posts through the respective pinned connections interconnecting the upper and lower portions of each supporting post assembly it will be seen that these connections can be disengaged to enable the building to be raised above the lower post portions for transport as a unit to another site. At an alternate site further lower post portions may be engaged and adjusted as required prior to the footing encased in mass concrete.

The features of this invention may be utilized in building structures other than prefabricated structures. For example the floor assembly can be used in a conventional building structure to provide ease and speed of assembly of the floor and of course prefabricated structures other than the square plan structure can be formed according to this invention. Furthermore, a floor which has been erected according to this invention can be accurately adjusted after assembly to ensure its trueness and plumbness. According, such floors will be very suited to the erection of elevated prefabricated structures.

It will of course be realised that the above has been given only by way of illustrative example of the present invention and that all such modifications and variations thereto as would be apparent skilled in the art are deemed to fall within the broad scope and ambit of the invention as is herein defined in the appended claims.

I claim:

1. An elevated base structure for a dwelling, said base structure being of the type having a plurality of post assemblies, floor supporting beams extending between said post assemblies, and wall framing extending above said floor supporting beams and being anchored to said post assemblies, characterized in that each said post assembly includes:

an elongate lower post having a foot portion supported on a supporting pad, an upper post including floor mounting brackets, said floor mounting brackets being attachable to opposed ends of adjacent floor beams;

said upper post being telescopically and releasably engaged about said lower post and adjustable stepwise along an upper portion of said post;

releasable locking means disposed between said lower post and said upper post for locking said post assembly at a selected length, and three screw adjusters mounted in horizontally spaced relationship on said foot portion and being extendible away from said lower post for engagement with said support pad supporting said post assembly whereby the inclination of said lower post may be adjusted and the height of said lower post may be adjusted through a range at least equal to one step of said stepwise adjustment.

2. An elevated base structure as defined in claim 1, wherein said locking means includes locking apertures formed in respective post portions and an adjusting pin engageable with said locking apertures.

3. An elevated base structure as defined in claim 1, wherein selected ones of said upper post portions are provided with roof column mounting means.

4. An elevated base structure as defined in claim 1 wherein selected ones of said upper post portions extend upwardly beyond respective said floor mounting brackets to form roof supporting columns above respective said floor mounting brackets.

5. An elevated base structure as defined in claim 1 wherein said lower post includes a tubular portion said tubular portion being attached to a foot portion in the form of a foot plate disposed across its lower end.

6. An elevated base structure as defined in claim 5, wherein said foot plate is triangular and wherein said screw adjusters are disposed adjacent the vertices of said foot plate.

7. An elevated base structure for a building, said base structure being of the type having a plurality of post assemblies, floor supporting beams extending between said post assemblies, and wall framing extending above said floor supporting beams and being anchored to said post assemblies, characterized in that each said post assembly includes:- an elongate lower post having a foot portion;

an upper post fixed through mounting brackets thereon to said floor supporting beams;

said upper post being telescopically and releasably engaged about an upper portion of said lower post and being provided with coarse adjustment means for maintaining said telescopic adjustments;

releasable locking means disposed between said lower post and said upper post for locking said post assembly at a selected length, and three screw adjusters mounted in horizontally spaced relationship on said foot portion and being extendible away from said lower post for engagement with a support pad supporting said post assembly whereby the inclination of said lower post may be adjusted and the height of said lower post may be finely adjusted through a range at least equal to one step of said stepwise adjustment to level said floor supporting beams.

* * * * *